United States Patent [19]

Robinson

[11] 4,270,706

[45] Jun. 2, 1981

[54] REVERSIBLE TOILET PAPER HOLDER

[76] Inventor: Gene P. Robinson, 4661 Larson Way, Sacramento, Calif. 95822

[21] Appl. No.: 159,863

[22] Filed: Jun. 16, 1980

Related U.S. Application Data

[63] Continuation-in-part of Ser. No. 35,326, May 2, 1979, Pat. No. 4,241,885.

[51] Int. Cl.[3] ..... B65H 19/02

[52] U.S. Cl. ..... 242/55.2

[58] Field of Search ..... 242/55.2, 55.3, 55.53, 242/55.54; 248/447, 454, 479, 214, 217.2, 222.3, 257, 296

[56] References Cited

U.S. PATENT DOCUMENTS

| | | | |
|---|---|---|---|
| 1,687,819 | 10/1928 | Worthington | 242/55.2 |
| 3,162,390 | 12/1964 | Meyer | 242/55.54 |
| 3,227,386 | 1/1966 | Pitcher | 242/55.2 |

*Primary Examiner*—Stanley N. Gilreath

[57] ABSTRACT

A holder for dispensing rolled material, such as toilet paper, supporting the roll on a turntable so that the direction of unrolling of the paper or other material can be readily reversed without necessitating removal of the roll from its mounting by rotating the turntable one-hundred-eighty degrees, thus reversing the rolled material end-for-end, with means for latching in either dispensing position.

7 Claims, 6 Drawing Figures

REVERSIBLE TOILET PAPER HOLDER

This is a continuation-in-part of application Ser. No. 035,326 filed May 2, 1979, now U.S. Pat. No. 4,241,885.

The invention pertains generally to holders for dispensing of rolled materials, such as paper, and particularly to holders for rolled toilet paper. The invention has as one object the provision by means of a turntable for ready reversal of the direction of unrolling the rolled material, a provision not made in the current state of the art. A second object of the invention is to provide a push-button latch which positions the turntable into one of two potential dispensing positions. A third object of the invention is to provide a retaining member which holds the assembly onto the mounting surface, retaining the turntable at its perimeter. A fourth object of the invention is to provide for mounting either onto a flat surface or into a niche.

The invention is manufactured in three separate pieces which are assembled at the time of installation and mounted by means of screws or other suitable fasteners onto a wall or other surface as desired. The reversing motion is accomplished by rotation of a turntable which has supporting arms for the rolled material. Said supporting arms may be attached to, or molded or cast as integral parts of, the turntable. The turntable can be manufactured in either of two styles for mounting onto a flat surface or into a recess. Latching in one of two optional dispensing positions is provided by means of a flat spring arm on which is a pushbutton that snaps into one of two diametrically opposed holes in the turntable or into one of two diametrically opposed notches in the retaining member, depending upon where the spring arm is mounted. The retaining member, made in two pieces to facilitate assembly, has a large center hole to permit freedom of access to the rolled material and turntable, yet imparts great strength of assembly by lapping over the outer perimeter of the turntable.

Figure 1:
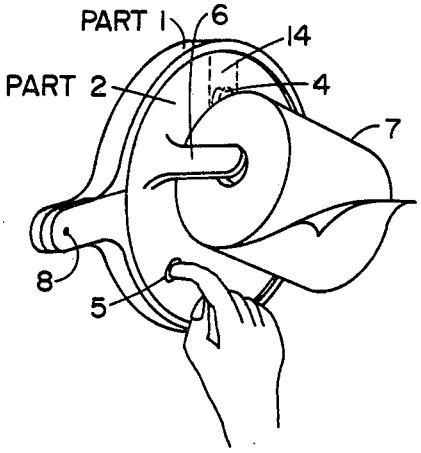
FIGS. 1 and 2 are perspective views showing operation of the invention using two different latching means.
Figure 2:
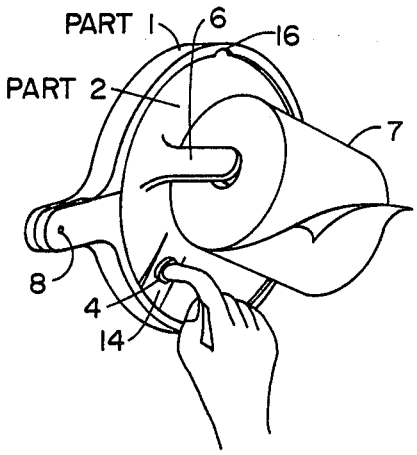

Referring now in detail to the drawing, FIGS. 1 and 2 show operation of the invention with the turntable partially rotated between the two latching positions. The user is rotating turntable part 2 after having depressed latch button 4, freeing turntable part 2 to rotate in either direction until the flat spring arm 14 snaps the latch button 4 back up into the retaining hole 5 in turntable part 2 or notch 16 in retaining ring member part 1, as rotation by the user continues. After rotation of turntable part 2 through 180 degrees, the rolled material 7, held between support arms 6, is seen to assume a dispensing direction of unrolling reversed from its initial direction.

Figure 3:
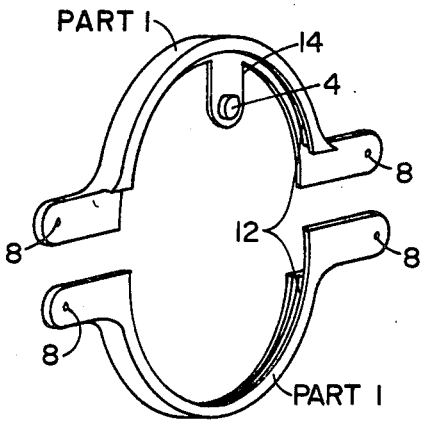
FIG. 3 is a perspective view of the retaining member incorporating latching means.
Figure 4:
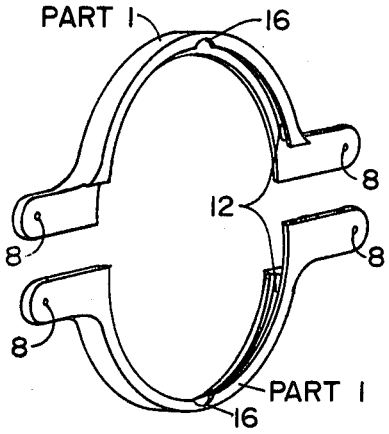
FIG. 4 is a perspective view of the retaining member without latching means.
Figure 5:
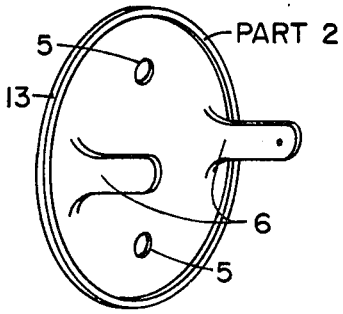
FIG. 5 is a perspective view of the turntable without latching means.
Figure 6:
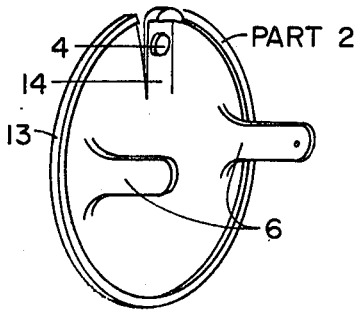
FIG. 6 is a perspective view of the turntable incorporating latching means.

FIGS. 3 and 5 show one possible combination of member parts in which the flat spring arm 14 is attached to or integral with retaining ring member part 1 and the latch button 4 engages one of two diametrically opposed holes 5 in turntable part 2. FIGS. 4 and 6 show another possible combination of member parts in which flat spring arm 14 is attached to or integral with turntable part 2 and its tip portion engages one of two diametrically opposed notches 16 in retaining ring member part 1.

FIGS. 3 and 4 show that retaining ring member part 1 is manufactured in two pieces with overlapping segments secured in assembly when mounted on the wall or other surface by suitable fastener means applied through matching mounting holes 8. Retaining ring member part 1 is seen to have a grooved periphery 12 which serves to guide and retain in assembly the turntable part 2.

FIGS. 5 and 6 show turntable part 2 with a relatively flat surface suitable for mounting onto a wall or other flat mounting surface. It is also possible to manufacture turntable part 2 with a concave central portion, reducing the protrusion of roll support arms 6, for mounting into a niched mounting surface. Whether flat or concaved, the turntable part 2 is retained at its periphery by retaining ring member part 1 which has groove 12 overlapping the thickened edge 13 on turntable part 2.

I claim:

1. A rotatable dispenser suitable for wall or other surface mounting for holding a roller and toilet paper or other rolled material comprising, a turntable, said turntable having two spaced supporting arms for receiving the roller for the rolled material for rotation about the axis of the roller, means for rotatably retaining said turntable with freedom to rotate about an axis perpendicular to the axis of said roller in assembled position and latch means for holding said turntable in a desired dispensing position relative to said retaining means.

2. A rotatable dispenser as defined in claim 1 wherein said latch means comprises a spring activated latching projection attached to or integral with said retaining means engaging one of two holes or notches in said turntable.

3. A rotatable dispenser as defined in claim 1 wherein said latch means comprises a spring activated latching projection attached to or integral with said turntable means engaging one of two holes or notches in said retaining means.

4. A rotatable dispenser as defined in claim 1 wherein said retaining means include a grooved ring member for rotatably receiving said turntable with said spaced supporting arms projecting through said ring member.

5. A rotatable dispenser as defined in claim 4 wherein said retaining means grooved ring member is made in seperable parts to facilitate assembly surrounding said turntable.

6. A rotatable dispenser as defined in claim 1 wherein said turntable is substantially planar for mounting on a substantially flat surface.

7. A rotatable dispenser as defined in claim 1 wherein said turntable includes a concave portion whereby said concave portion may be operably received within a recess in said wall or other mounting surface.

* * * * *